US006058838A

United States Patent [19]

Yamashita

[11] Patent Number: 6,058,838

[45] Date of Patent: May 9, 2000

[54] MACHINE PLATE FASTENING MEANS, PLATE CYLINDER FITTED WITH SAID FASTENING MEANS, AND OFFSET PRINTING MACHINE EQUIPPED WITH SAID PLATE CYLINDER

[75] Inventor: Miyuki Yamashita, Tokyo, Japan

[73] Assignee: Hirakawa Kogyo Sha Co., Ltd., Tokyo, Japan

[21] Appl. No.: 09/060,366

[22] Filed: Apr. 15, 1998

[30] Foreign Application Priority Data

Apr. 16, 1997 [JP] Japan ..... 9-114289
Feb. 20, 1998 [JP] Japan ..... 10-55782

[51] Int. Cl.[7] ..... B41F 27/00

[52] U.S. Cl. ..... 101/382.1; 101/383

[58] Field of Search ..... 101/382.1, 383, 101/384, 415.1, 407.1, 480, 385

[56] References Cited

U.S. PATENT DOCUMENTS

| | | | |
|---|---|---|---|
| 2,252,167 | 8/1941 | Coy | 101/385 |
| 4,036,133 | 7/1977 | Kocsis et al. | 101/383 |
| 4,223,604 | 9/1980 | Brehm et al. | 101/383 |
| 5,014,619 | 5/1991 | Jeschke | 101/383 |
| 5,370,051 | 12/1994 | Schild et al. | 101/415.1 |
| 5,526,746 | 6/1996 | Capdeboscq | 101/382.1 |

*Primary Examiner*—Eugene Eickholt
*Attorney, Agent, or Firm*—Millen, White, Zelano & Branigan, P.C.

[57] ABSTRACT

There are provided a machine plate fastening means for an offset printing machine, which is placed on the upper clamp plate of a PS plate lock-up device fitted in the cut-off part of a plate cylinder used for an offset printing machine so that it is attachable to or detachable from the clamp plate by the use of at least two bolts; with the fastening means comprising (i) a lower plate having the back part which is attached to the PS plate lock-up device with the bolts, the middle part over which a machine plate is fastened by putting fastening pins in the fastening holes punched therein and the front part for introducing the insertion of the machine plate, (ii) one or more of a leaf spring for pressing the machine plate, which is inserted and fastened by the fastening pins at the fastening holes, so as to prevent the machine plate from slipping off the fastening pins and (iii) an upper plate laid on the lower plate directly or via a spacer so that it is united to the back part of the lower plate; wherein the fastening pins are fixed to the middle part of the lower plate so as to project into the space above the lower plate when the upper plate is arranged only on the back part of the lower plate.

16 Claims, 8 Drawing Sheets

MACHINE PLATE FASTENING MEANS, PLATE CYLINDER FITTED WITH SAID FASTENING MEANS, AND OFFSET PRINTING MACHINE EQUIPPED WITH SAID PLATE CYLINDER

FIELD OF THE INVENTION

The present invention relates to a machine plate fastening means which, by the use of at least two bolts, can be simply attached to and detached from an upper clamp plate of a conventional presensitized plate lock-up device with which a plate cylinder used for an offset printing machine is equipped and, more particularly, to a machine plate fastening means which can markedly improve the working efficiency in attaching and detaching a machine plate to a plate cylinder when the machine plate is a paper plate or a film plate; and further to a plate cylinder fitted with such fastening means and an offset printing machine equipped with such a plate cylinder.

BACKGROUND OF THE INVENTION

For offset printing, the plates which have been used prevailingly have been not only a presensitized plate using an aluminum plate as a substrate (hereinafter referred to as "a PS plate") but also a presensitized plate using paper or a plastic film, e.g. a polyester film, as a substrate (hereinafter referred to as "a paper plate" or "a film plate" respectively). In particular, the use of a low-priced paper or film plate has markedly increased in frequency because of a recent tendency to diversify the purpose of printing and require a small number of copies in printing. Under these circumstances, reduction in time required for replacement work of machine plates has become a great problem.

In a case where a printing of a small number of copies, such as 300 copies, was required, although the printing time from the start to the finish of printing was about 5 minutes, the time required to replace of machine plates was at least 5 minutes in the past. In other words, in some cases the time for attachment of a machine plate was longer than the net printing time. Therefore, many devices which enable a reduction in working time for replacement of machine plates have been proposed in recent years. For instance, such devices are disclosed in Tokkai Sho 59-1262, Tokkai Hei 3-93546, Tokkai Hei 6-328669, Tokkai Hei 8-39779 (The term "Tokkai" as used herein means an "unexamined published Japanese patent application"), Jikkai Hei 3-19037, Jikkai Hei 3-45133, Jikkai Hei 3-45134 (The term "Jikkai" as used herein means an "unexamined published Japanese utility model application"), and Jikko Hei 6-11782 (The term "Jikko" as used herein means an "examined Japanese utility model publication").

A machine plate mounted on a plate cylinder, which is equipped with a device such as described in those gazettes, has a plurality of circular holes for fastening purpose (basic holes) which are punched in a row at each end situated in the length direction thereof, and each of those devices has machine plate fastening pins (basic pins) which are fitted in the desired positions of a PS plate lock-up device placed in the cut-off part of a plate cylinder. Thus, the machine plate registering and fastening operation is performed by inserting the basic pins in the basic holes.

Each of those devices requires a PS Plate lock-up device or/and a plate cylinder to undergo certain direct procedures for fixing machine plate fastening pins (basic pins) thereto. However, it is difficult to perform accurate work at the job site. In attaching such a device to a printing machine which has already been in operation, therefore, it is necessary to detach the parts to be worked on from the printing machine and to work on them with a NC machine in order to secure printing accuracy; as a result, the operations at the job site increase in complexity.

For instance, the machine plate attaching device described in Japanese Jikko Hei 6-11782, has basic pins which are provided so as to project out from the upper surface of clamp plates of a PS plate lock-up device and which are inserted in basic holes from the lower side of the machine plate. Further, that attaching device is fitted with plates which are designed so as to cover the basic pin zone and press a machine plate to the upper surface of the clamp plates of the PS plate lock-up device (and so these plates are abbreviated as "presser plates" hereinafter). Although such a device improves the working efficiency in attaching a machine plate to a plate cylinder when the machine plate is made of paper, workers are liable to be injured by presser plates. In addition, when the machine plate to be attached is made of a material having high elasticity, such as a plastic or aluminum sheet, such a device has a disadvantage in that, as the machine plate is apt to come up and get out of basic pins due to the reaction force the machine plate has when it is curved along the peripheral direction of a plate cylinder, it has a tendency to slide off the plate cylinder upon attaching operation.

Further, it is hard to detach a machine plate from the plate cylinder by lifting it up from the plate cylinder at the conclusion of a printing operation, because the presser plates are mounted so as to press the basic hole zone of the machine plate to the upper surface of clamp plates. Accordingly, Japanese Jikko Hei 6-11782 describes that at the conclusion of a printing operation the paper-made machine plate is detached from a plate cylinder by pulling the machine plate with a jerk in the direction of leaving the plate cylinder to break the machine plate at the basic holes. However, the way of breaking a machine plate upon detachment is unsuitable for plates hard to break, such as a plastic plate and an aluminum plate. This drawback of the attaching device cited above is not to be lightly disregarded.

Additionally, although the reusing of a plastic plate or an aluminum plate once used is desired in some cases, it is beyond the pale of the foregoing attaching device.

On the other hand, the machine plate attaching device described in Japanese Tokkai Hei 6-328669 is fitted with basic pins and, if desired, plates for pressing a machine plate (presser plates), and these fastening means are arranged between the clamp plate and the support of a PS plate lock-up device. Therefore, this device has an improvement over the aforementioned device with respect to the protection against injuries to workers. Further, this gazette discloses new embodiments wherein the basic pins are inserted in basic holes of a machine plate from the upper side of the machine plate towards the lower side thereof. These new embodiments can bring about an improvement in the aforementioned undesirable situation that the machine plate comes up and gets out of basic pins due to the reaction force the machine plate has when it is curved along the peripheral direction of a plate cylinder upon attaching operation, and thereby it is apt to slide off the plate cylinder. However, as the basic pins of the attaching device are designed so as to have almost the same diameter as the basic holes of a machine plate to be attached, it is difficult to insert the basic pins in the basic holes, resulting in the lowering of workability.

Furthermore, those machine plate attaching devices are obtained by fixing basic pins and other attachments to a conventional PS plate lock-up device fitted in the cut-off part of a printing drum in order to make improvements thereon, so that the resulting plate cylinders become expensive because of their complex structure, compared with conventional ones.

SUMMARY OF THE INVENTION

A first object of the present invention is therefore to provide a fastening means for easily attaching to and detaching from a paper or film machine plate a press cylinder, which is attached to the upper clamp plate of a PS plate lock-up device, which is placed in the cut-off part of the press cylinder, at the job site via bolt holes drilled in the upper clamp plate.

A second object of the present invention is to provide a machine plate fastening means which can be fitted to a PS plate lock-up device without causing damage to the original function of the PS plate lock-up device, and enables not only easy and sure attachment of a paper or film machine plate to the intended position of the periphery of a plate cylinder but also easy detachment of the machine plate therefrom at the conclusion of printing operation without breaking the basic holes of the machine plate.

A third object of the present invention is to provide a plate cylinder used for an offset printing machine, which has both the function of a PS plate lock-up device and the function of not only attaching a paper or film machine plate to the intended position of the periphery of the plate cylinder with ease and certainty but also detaching the machine plate with ease at the conclusion of a printing operation without breaking the basic holes of the machine plate.

A fourth object of the present invention is to provide an offset printing machine having excellent operation efficiency, wherein not only can the printing operation using a PS plate be performed by means of a PS plate lock-up device as usual but also rapid attachment and detachment of a paper or film machine plate is ensured.

The above-described objects are attained with a machine plate fastening means, which is placed on an upper clamp plate of a PS plate lock-up device fitted in a cut-off part of a plate cylinder used for an offset printing machine so that it is attachable to or detachable from the clamp plate by the use of at least two bolts; with the fastening means comprising (i) a lower plate having the back part which is attached to a PS plate lock-up device with the bolts, the middle part over which a machine plate is fastened by putting fastening pins in a fastening holes punched therein and a front part for introducing the insertion of the machine plate, (ii) one or more of a leaf spring for pressing a machine plate inserted and fastened by the fastening pins at the fastening holes so that the machine plate is prevented from slipping off the fastening pins and (iii) an upper plate laid on the lower plate directly or via a spacer so that it is united to the back part of the lower plate; wherein, when the upper plate is arranged only on a back part of the lower plate, the fastening pins are fixed to the middle part of the lower plate so as to project into the space above the lower plate, or when the front part of the upper plate extends over the middle part of the lower plate so as to form a space for fastening a machine plate when inserted, the fastening pins are fixed to the middle part of the lower plate or the front part of the upper plate so as to project into the space between the upper plate and the lower plate, and the leaf spring has a bent form and a hole or holes punched out so as to correspond to the fastening pins and enable the fastening pins to go therethrough: and further with a plate cylinder having the aforementioned machine plate fastening means and an offset printing machine equipped with the aforesaid plate cylinder.

In accordance with embodiments of the present invention, the attachment of a machine plate fastening means is very easy since a machine plate fastening means can be attached to the upper clamp plate, wherein holes for bolts are bored in advance, only by fastening them with bolts. In a special case where a machine plate fastening means is designed SO as to have a length slightly shorter than the length of a PS plate lock-up device, the fastening pins can be fitted in the intended positions with ease and with high accuracy by the use of a NC processing machine; as a result, the present machine plate fastening means can sufficiently answer strict requirements for the registration of machine plates in color printing. In addition, the present machine plate fastening means can significantly heighten the efficiency in replacement work of machine plates.

Figure 1:
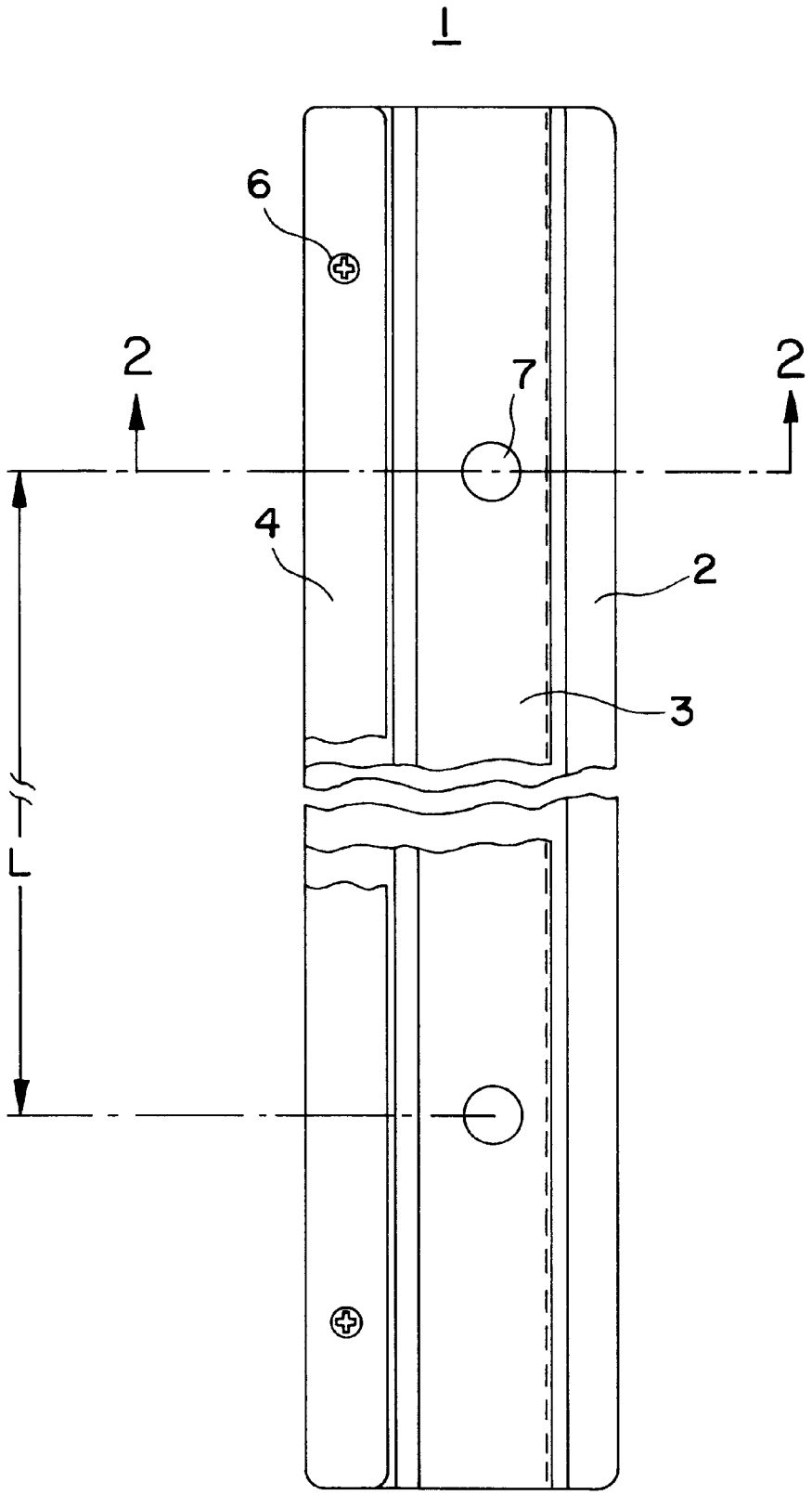
FIG. 1 is a ground plan of a machine plate fastening means according to a first embodiment of the present invention, the total length of which is slightly shorter than the length of a PS plate lock-up device.

In those figures, the numeral 1 denotes a machine plate fastening means according to the present invention, the numeral 2 denotes a lower plate, the numeral symbol 2-1 denotes the back part of a lower plate, the numeral symbol 2-2 denotes the middle part of a lower plate, the numeral symbol 2-3 denotes the front part of a lower plate, the numeral 3 denotes a leaf spring, the numeral symbol 3-1 denotes the machine plate pressing part of a leaf spring, the numeral symbol 3-2 denotes the bent part of a leaf spring, the numeral 4 denotes an upper plate, the numeral 5 denotes a fastening pin, the numeral symbol 5-1 denotes the slope part of a fastening pin, the numeral symbol 5-2 denotes the smoothly planed side face of a fastening pin, the numeral symbol 5-3 denotes the taper part of a fastening pin, the numeral 6 and the numeral 6' each denote a bolt, the numeral 7 denotes a hole for confirmation, the numeral 8 denotes a spacer, the numeral 9 denotes a hollow, the numeral 20 denotes a plate cylinder, the numeral 21 denotes the clamp plate of a PS plate lock-up device, and the numeral 22 denotes the stand of a PS plate lock-up device.

DETAILED DESCRIPTION OF THE INVENTION

The present invention is illustrated below by figures, but the invention should not be construed as being limited to the embodiments shown in those figures.

Figure 2:
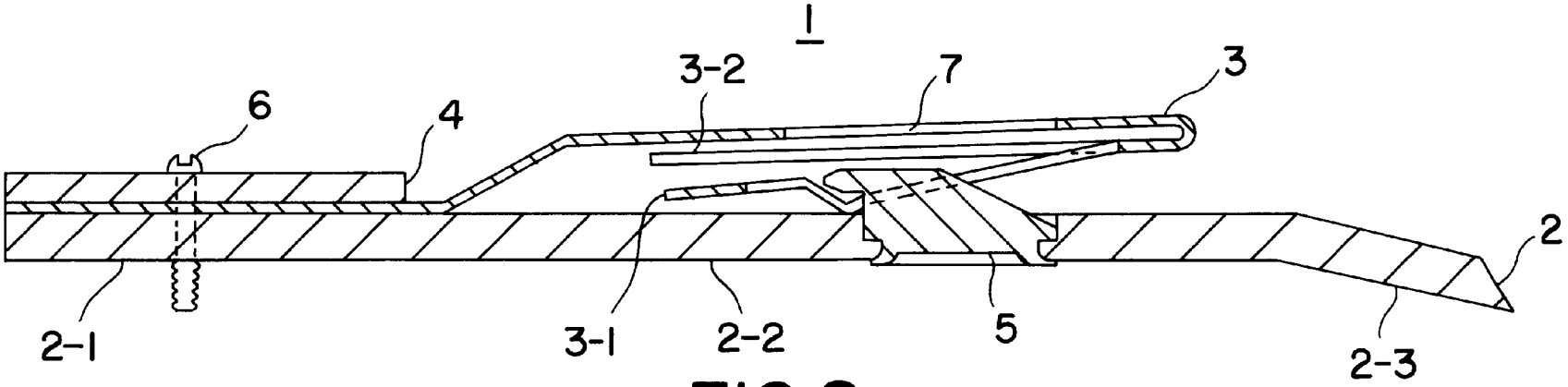
FIG. 2 is a sectional plan of the machine plate fastening means of FIG. 1, which is cut by the A–A' plane shown in FIG. 1 and drawn on a magnified scale for showing the details of the fastening means.
Figure 3:
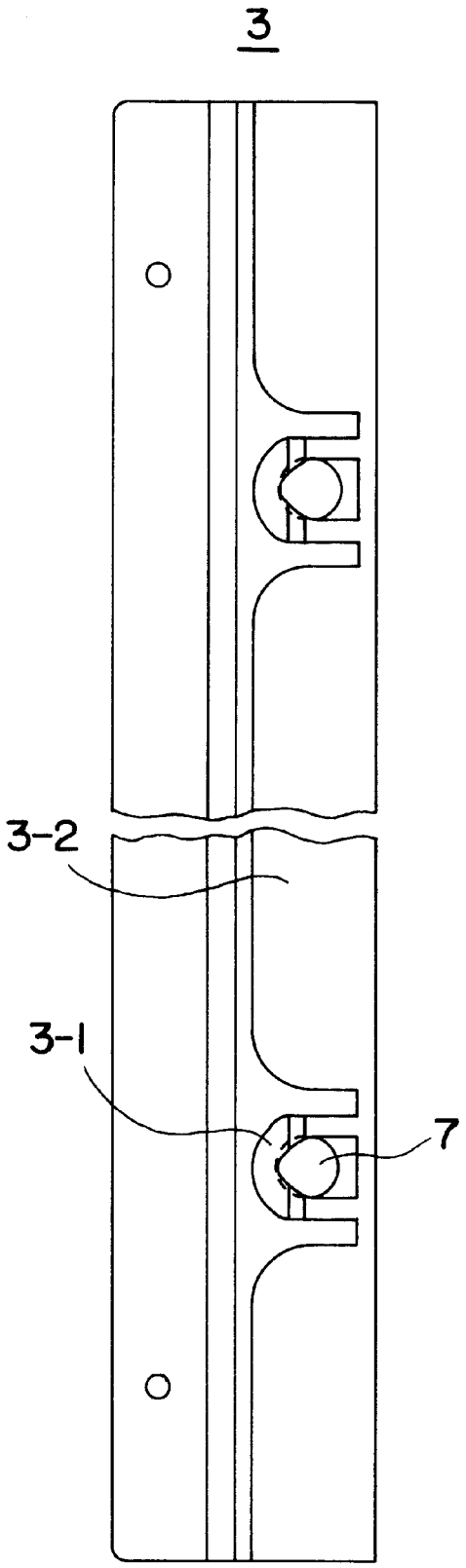
FIG. 3 is a bottom plan of a leaf spring shown in FIG. 1.

FIG. 1 is a ground plan of a machine plate fastening means according to a first embodiment of the present invention, FIG. 2 is a magnified sectional plan cut by the A–A' plane shown in FIG. 1, and FIG. 3 is a bottom plan of a leaf spring. In these figures, the numeral 1 denotes a machine plate fastening means according to the present invention, the numeral 2 denotes a lower plate, the numeral 3 is a leaf spring which is bent so as to enable the insertion of a machine plate, the numeral 4 is an upper plate, the numeral 5 is a machine plate fastening pin, the numeral 6 is a bolt, and the numeral 7 is a hole for confirming the fit between a fastening pin and a fastening hole made in a machine plate.

Further, the numeral symbol 2-1 denotes the back part of a lower plate, on which an upper plate is arranged so that these plates are united; the numeral symbol 2-2 denotes the middle part of a lower plate, over which a machine plate is held; the numeral symbol 2-3 denotes the front part of a lower plate, which is curved downward so as to ensure the smooth insertion of a machine plate; the numeral symbol 3-1 denotes the machine plate pressing part of a leaf spring, which presses a machine plate inserted and caught by the fastening pins 5 so that the machine plate is prevented from slipping off the fastening pins; and the numeral symbol 3-2 denotes the bent part of a leaf spring.

Figure 4:
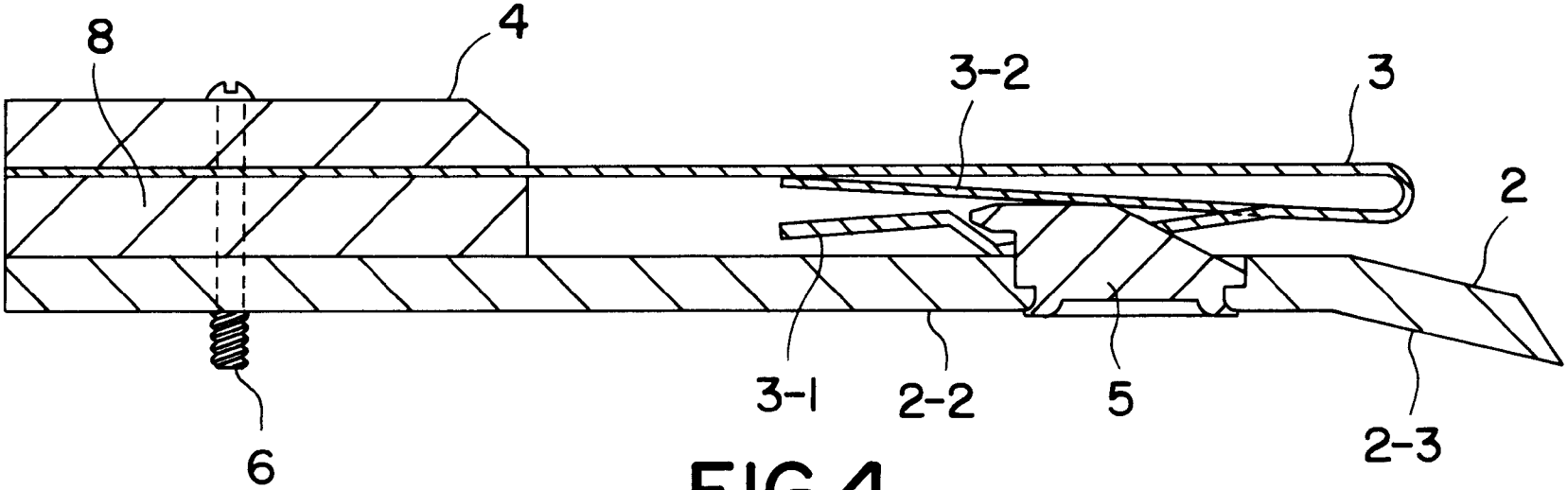
FIG. 4 is a sectional plan of a machine plate fastening means according to a second embodiment of the present invention, wherein the space for the insertion of a machine plate is formed by arranging a spacer between the upper plate and the lower plate. This figure is also drawn on a magnified scale for showing the details of the fastening means.

FIG. 4 is a sectional plan of a machine plate fastening means according to a second embodiment of the present invention, wherein the leaf spring used has no upwardly bent part in contrast to the leaf spring shown in FIG. 2 but a spacer 8 is arranged between the upper plate and the lower plate to form a space for the insertion of a machine plate.

The leaf spring can be made by stamping out a steel sheet in an intended shape and bending it. The use of a leaf spring having a bent form can protect workers against injury. In the aforementioned two embodiments, the leaf spring, the upper plate and the lower plate are designed so as to have the same length and be shorter than the length of a PS plate lock-up device installed in a plate cylinder. The distance between fastening pins (which is represented by L in FIG. 1) is equal to the distance between fastening holes punched in a machine plate, and the optimum thereof is 550 mm in usual cases where the machine plate to be fastened has a size of the order of A1-B2. In these cases, therefore, the lower plate and so on are each required to have a length of no shorter than 560 mm.

In the case of a printing machine of a small size wherein machine plates of A3 and A4 sizes are used, it is natural that the distance L becomes short, compared with the foregoing optimum.

In other words, it is desirable for the lower plate and so on to have a length to enable the attachment of a machine plate having a full size.

Although the leaf spring illustrated in FIG. 1 and FIG. 3 has the same length as the lower plate, a leaf spring according to the present invention is not always required to have the same length as the lower plate, but it may be arranged so as to be present only in the neighborhood of each fastening pin, as hereinafter illustrated in FIG. 5 and FIG. 6, namely so as to cover such a limited area as to be substantially useful for pressing the machine plate caught by the fastening pin to prevent it from sliding off the fastening pin.

Similarly to the leaf spring, an upper plate according to the present invention is not always required to have the same length as the lower plate, but the length required for uniting a upper plate, a leaf spring and a lower plate in a body in a condition that a leaf spring is put between the upper plate and the lower plate will suffice for the length of the upper plate. In other words, such a length as to ensure the holding of a leaf spring between the upper plate and the lower plate is sufficient for the length of the upper plate. Therefore, two upper plates provided on two leaf springs respectively may be arranged separately so as to correspond to the two fastening pins fixed to the lower plate.

The upper plate, the leaf spring and the lower plate can be easily united together by means of at least two bolts. However, other uniting means, such as adhesives, may be used independently, as well as in combination with bolts. Also, the spacer may be united by making the spacer and the lower or upper plate in a body.

The lower plate-united part of the upper plate and its corresponding part (the back part 2-1) of the lower plate are each pierced in at least two holes through which bolts are passed in order to fix those plates to the upper clamp plate of a PS plate lock-up device. These holes each may be made in such a shape as to fit the spiral ridge of a bolt used. On the other hand, each hole may be made so that it has a diameter somewhat greater than a bolt used or it is elliptical in shape to loosely fit the bolt used, thereby enabling minute adjustment of the inclination of the present fastening means relative to the upper clamp plate and the position at which the present fastening means is attached to the upper clamp plate.

The bolts for attaching the present fastening means to the upper clamp plate can be used as the bolts for uniting the upper plate, the leaf spring and the lower plate, too. Thus, the holes into which the bolts for attaching the present fastening means are screwed are bored in the intended positions of the upper clamp plate of a PS plate lock-up device. Desirably, these holes are bored in a depth about a half of the thickness of the upper clamp plate so as not to pass through the upper clamp plate, thereby enabling the PS plate lock-up device to fulfill its function, whether or not it is fitted with the machine plate fastening means.

In the present embodiments as mentioned above, it is possible to easily and accurately attach the fastening means to the plate cylinder by putting a mark on the center of the fastening means in the length direction and adjusting this mark to another mark put on the center of the upper clamp plate in the length direction. In order to fasten a machine plate so that it can undergo a printing operation, at least two fastening pins are required. Thus, when the fastening means is longish (or substantially the same in length as the upper clamp plate), it is provided with at least two fastening pins. On the other hand, it is possible to let the lower plate also have such a reduced length as to be present only in the neighborhood of each fastening pin, similarly to the upper plate and the leaf spring. In such a case, even when the fastening means is fitted with two fastening pins, it functions as if only one fastening pin were present. In this case, therefore, at least two of the present fastening means are arranged so as to make a bilateral pair and be symmetric with respect to the center of the clamp plate in the length direction, thereby enabling the machine plate to undergo a printing operation. Therein, it is required to previously mark at the intended positions of the clamp plate so as to indicate the places to which the fastening means are to be attached.

Figure 5A:
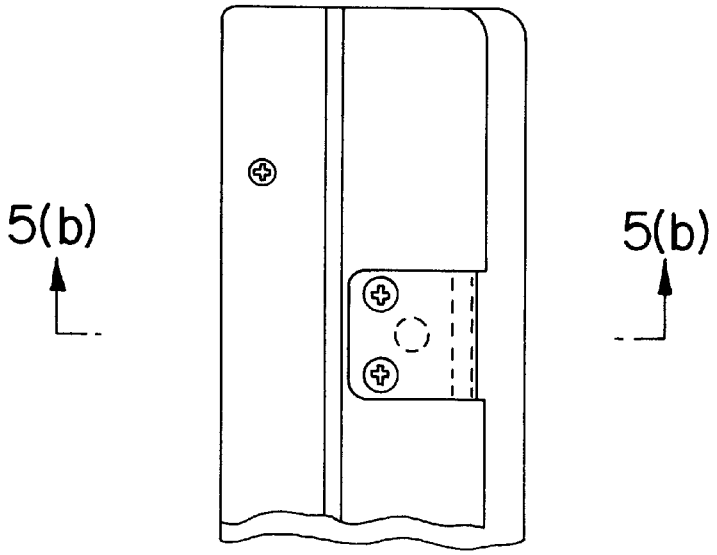
FIG. 5 shows a ground plan of a machine plate fastening means according to a third embodiment of the present invention and a sectional plan thereof cut by B–B' plate, wherein the upper plate is fitted up with leaf springs in limited areas.
Figure 5B:
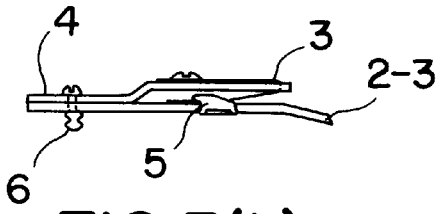
Figure 5C:
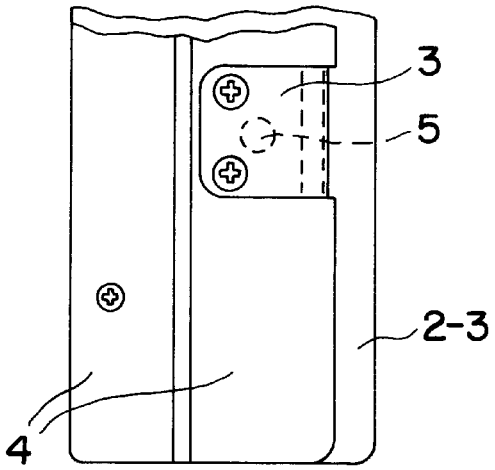

FIG. 5 shows a third embodiment of the present machine plate fastening means. As is apparent from the sectional plan cut by B–B' plane (the middle figure (b)), the upper plate 4 is bent into a step to enable the insertion of a machine plate between the upper plate and the middle part of the lower plate and extended to the position at which the leaf spring is bent, in contrast to the first embodiment. As is also apparent from the ground plan (the upper and lower figures (a) and (c)), each leaf spring 3 is fitted to the upper plate 4 with two bolts arranged so as to situate above a fastening pin 5 and on either side thereof. On the other hand, the leaf spring can have an enough length to cover all of the fastening pins, in analogy with the first embodiment shown in FIG. 1. In this (third) embodiment, as shown in the figures (a) and (c), the leaf spring is bent down at the cut-off part formed at the forefront of the upper plate, and inserted between the upper plate and the lower plate. However, these cut-off parts are not always required.

In this embodiment also, the length (in the length direction of a plate cylinder) of the upper plate and that of the lower plate can be changed properly. Either the upper plate or the lower plate, or both of them can be designed so as to have a desired length, provided that the length desired is longer than that of the leaf spring. From the viewpoint of easiness in handling, however, each of those plates naturally has its length limit. In a case where those plates are used in pairs for fastening a machine plate, it is desirable for each plate to have such a length as to enable the use on either side.

Further, it is desired that the front part 2-3 of the lower plate be bent downward in order to enable an easy insertion of a machine plate.

Figure 6A:
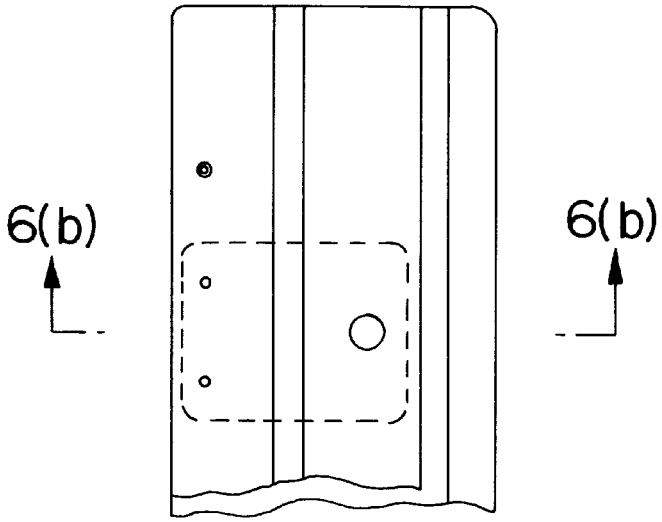
FIG. 6 shows a ground plan of a machine plate fastening means according to a fourth embodiment of the present invention wherein fastening pins are fixed to the upper plate, and a sectional view thereof cut by the C–C' plane.
Figure 6B:
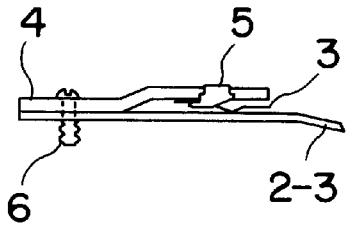
Figure 6C:
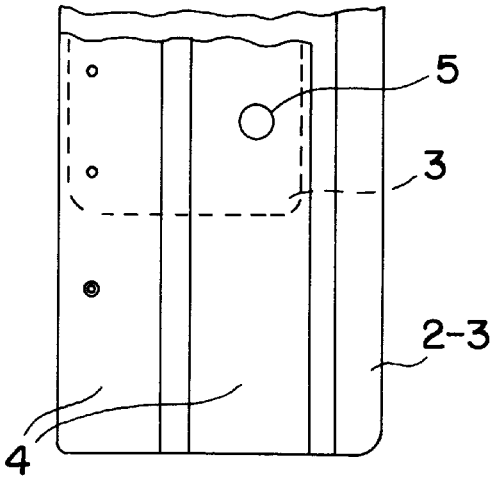

FIG. 6 shows a fourth embodiment of the present machine plate fastening means. In this embodiment, the plate to which machine plate fastening pins are fixed is not the lower plate but the upper plate, in contrast to the foregoing embodiments. The leaf spring is arranged between the upper plate and the lower plate and held in the united part of those plates with bolts. Also, the leaf spring may be fitted to the under side of the lower plate with bolts and bent upwardly so as to be inserted between the upper plate and the lower plate.

In addition, the upper plate, the lower plate and the leaf spring each can be designed so as to have a proper length, as similarly mentioned in the foregoing embodiments.

Figure 7A:
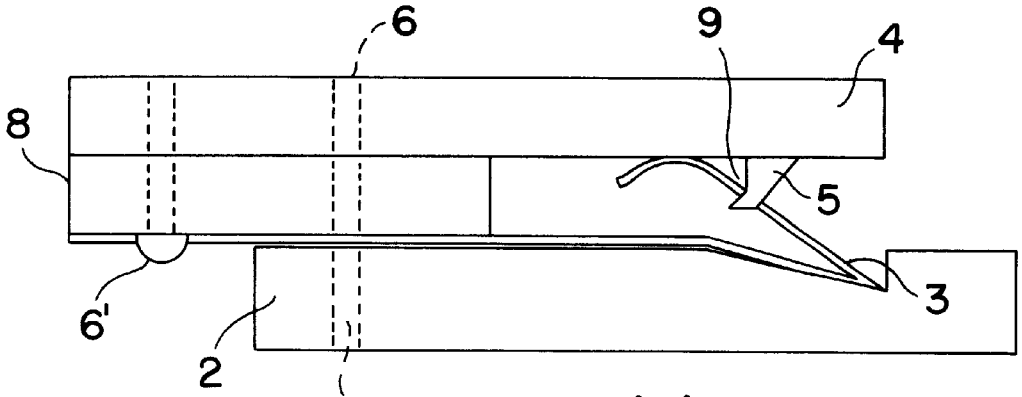
FIG. 7 shows a sectional plan (a), which is drawn on a magnified scale, and a ground plan (b) of a machine plate fastening means according to a fifth embodiment of the present invention, wherein fastening pins are also fixed to the upper plate.
Figure 7B:
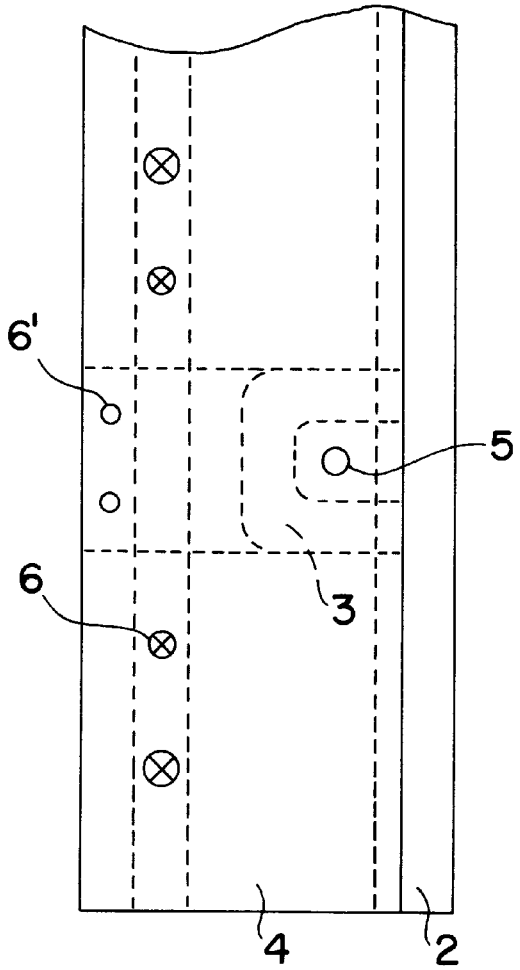

FIG. 7 shows a fifth embodiment of the present machine plate fastening means. In this embodiment similarly to the fourth embodiment, the plate to which machine plate fastening pins are fixed is not the lower plate but the upper plate. In addition, a spacer is arranged between the upper plate and the lower plate. This spacer has a thickness to form a space into which a machine plate can be inserted, namely a thickness from 1 to 3 mm, and a width to allow at least the fore half part of the upper plate to extend beyond the front end of the spacer. The leaf springs are arranged between the spacer and the lower plate so as to correspond to the fastening pins respectively, and the back part of each leaf spring is attached to the spacer or/and held between the spacer and the lower plate, e.g., by means of bolts (6' or/and 6). The front part of each leaf spring is bent upwardly so that the end thereof substantially reaches the lower surface of the upper plate in the neighborhood of the fore edge to press the inserted machine plate to the upper plate, and the bent part thereof has holes which enables the fastening pins corresponding thereto to come out therethrough at least in their head part. The lower plate has substantially the same size and shape as the upper plate, but it is desirable that the upper surface of the lower plate be hollowed out in the area corresponding to the bent part of each leaf spring so that the bent edge of leaf spring can sink below the upper surface of the lower plate to ensure smooth insertion of a machine plate. Additionally, the upper plate, the lower plate and the leaf spring each can be designed so as to have a proper length, as similarly mentioned in the foregoing embodiments.

Figure 8A:
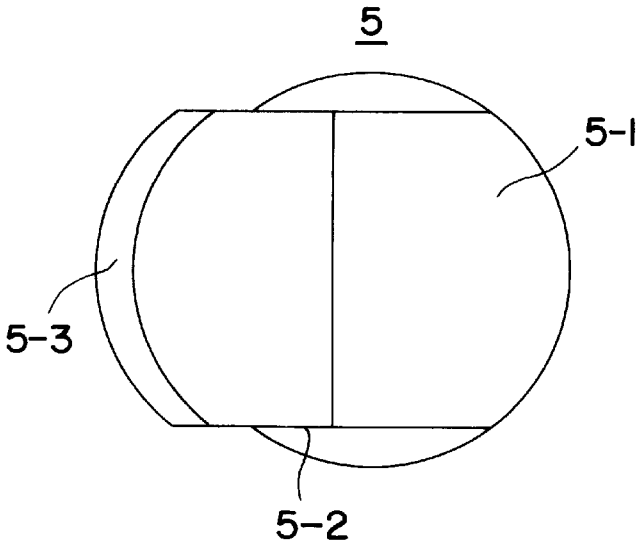
FIG. 8 shows a ground plan (a) and a side view (b) of a desirable fastening pin fixed to a machine plate fastening means according to the present invention.
Figure 8B:
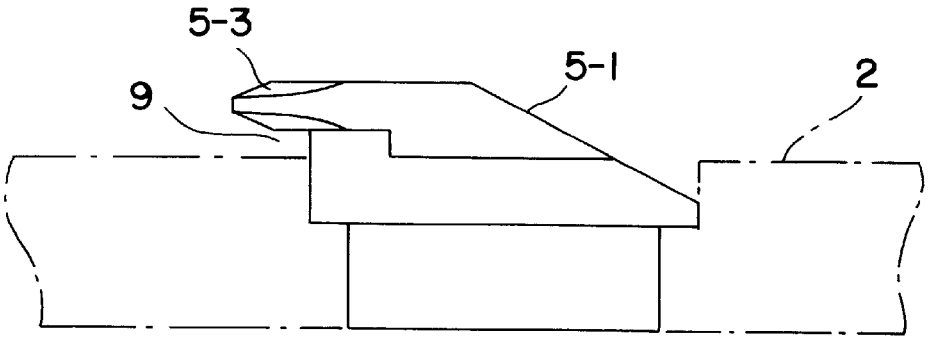

The present invention has no particular restrictions as to the shape of machine plate fastening pins, and so the fastening pins fixed to the present fastening means may have any known shapes. However, the shape shown in FIG. 8 is particularly preferred as the shape of the fastening pins used in the present invention. More specifically, FIG. 8(*a*) is a ground plan of the head part of a fastening pin, and FIG. 8(*b*) is a side view of a fastening pin in a state that the pin is fixed in the lower plate. In the figures, the numeral symbol 5-1 denotes the slope part formed by cutting a fore part of the pin head, which makes the insertion of a machine plate easy. Further, the numeral symbol 5-2 denotes the smoothly planed side face of a fastening pin, the numeral symbol 5-3 denotes the taper part which is formed at the end of a back part of the pin head so that the machine plate once fastened may be easily detached by being pushed laterally, and the numeral 9 denotes a hollow formed so as to prevent the fastened machine plate from coming off the fastening pins.

The fastening pin having the head as mentioned above can be easily made with high accuracy by the combined use of turning and milling machines.

Additionally, the position adjustment of the fastened machine plate in the length direction of the PS plate lock-up device can be made easily by cutting each pin side (5-2) so as to have smooth vertical plane. This cutting can produce great effect on the registration of a paper machine plate because it can soak up the expansion of a paper plate to prevent the wrinkle generation. Further, although the upper surface of the back part of the pin head, excepting the taper part, is flat in FIG. 8(*b*), it is not necessarily flat but may be convex. Each fastening pin can be fixed to the upper plate or the lower plate by use of any known means, such as caulking or riveting. Additionally, FIG. 8(*b*) has the lines drawn in the inner part of the fastening pin. These lines, other than those showing the taper part, appear in the making process of the fastening pin, but they have no influence on the outer shape.

Figure 9:
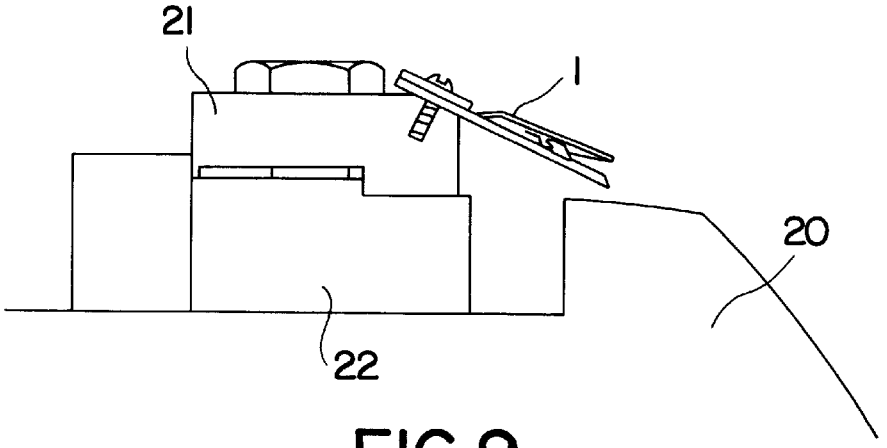
FIG. 9 is a schematic sectional view showing a state where the present machine plate fastening means is attached to the PS plate lock-up device of a plate cylinder by means of bolts.

FIG. 9 shows a state where a machine plate fastening means according to the present invention is attached with a bolt to the upper clamp plate of a PS plate lock-up device placed in a plate cylinder 20. Prior to the attachment of a machine plate to a plate cylinder, a both-sided adhesive sheet having high adhesiveness on one side and low adhesiveness on the other side is applied on its high adhesiveness side to the back side of a disused PS plate or the like. One end of the resulting PS plate or the like is clamped by a PS plate lock-up device placed on the head side of the plate cylinder with the adhesive sheet facing upward and the other end thereof is clamped by the other PS plate lock-up device placed on the tail side, thereby mounting the disused PS plate or the like on the plate cylinder.

The attachment of a machine plate can be effected by inserting fastening pins 5 into their corresponding fastening holes previously formed with high accuracy in the machine plate, and turning the plate cylinder so as to paste up the machine plate on the low adhesiveness side of the adhesive sheet applied to the back side of the disused PS plate or the like. In the replacement of machine plates, the machine plate attached is peeled from the both-sided adhesive sheet and the fastening holes are released from the fastening pins, and then a new machine plate is attached in the aforementioned way. This replacement work takes about 1 minute. Additionally, the adhesive sheet used is designed so as to have lower adhesiveness on the machine plate applied side than the PS plate applied side, so that the adhesive sheet itself does not peel off the PS plate upon the removal of a machine plate.

What is claimed is:

1. A machine plate fastening means for an offset printing machine: said means being placed on an upper clamp plate of a PS plate lock-up device fitted in a cut-off part of a plate cylinder used for an offset printing machine so that the fastening means is attachable to or detachable from the clamp plate by the use of at least two bolts, and comprising (i) a lower plate having a back part which is attached to the PS plate lock-up device with the bolts, a middle part over which a machine plate is fastened by putting fastening pins in fastening holes punched therein and a front part for introducing the insertion of the machine plate, (ii) one or more of a leaf spring for pressing the machine plate, which is inserted and fastened by the fastening pins at the fastening holes, so as to prevent the machine plate from slipping off the fastening pins, and (iii) an upper plate laid on the lower plate directly or via a spacer so that it is united to the back part of the lower plate; wherein, when the upper plate is arranged only on the back part of the lower plate, said fastening pins are fixed to a middle part of the lower plate so as to project into the space above the lower plate, or when the front part of the upper plate extends over the middle part of the lower plate so as to form a space for fastening the machine plate when inserted, said fastening pins are fixed to the middle part of the lower plate or the front part of the upper plate so as to project into the space between the upper plate and the lower plate, and said leaf spring has a bent form and a hole or holes punched out so as to correspond to the fastening pins and enable the fastening pins to go therethrough.

2. A machine plate fastening means described in claim 1, wherein the front part of the lower plate is projected forward from the position at which the leaf spring is bent.

3. A machine plate fastening means described in claim 1, wherein at least the lower plate has a length to enable the attachment of a machine plate having a full size.

4. A machine plate fastening means as described in claim 1, wherein the lower plate has two fastening pins arranged so as to make a bilateral pair and be symmetric with respect to the center of the clamp plate in the length direction.

5. A machine plate fastening means as described in claim 1, wherein the lower plate has on the back part a spacer to form a space for insertion of a machine plate.

6. A machine plate fastening means as described in claim 5, wherein the spacer and the upper plate or the lower plate are made in a body.

7. A machine plate fastening means as described in claim 1, wherein the upper plate is bent into a step to enable the insertion of a machine plate between the upper plate and the middle part of the lower plate.

8. A machine plate fastening means as described in claim 1, wherein the back part of the leaf spring is held between the upper plate and the lower plate in the united part of these plates.

9. A machine plate fastening means as described in claim 7, wherein the leaf spring is fitted to the upper side of the upper plate or the under side of the lower plate and bent downward or upward respectively at the fore end of the plate so as to be inserted between the upper plate and the lower plate.

10. A machine plate fastening means as described in claim 1, wherein the front part of the lower plate is curved downward so as to make the insertion of a machine plate easy.

11. A machine plate fastening means as described in claim 1; wherein at least the front half part of the upper plate is present over the middle part of the lower plate, the spacer is arranged on the lower surface of at most the back half part of the upper plate, the fastening pins are fixed to the lower surface and front part of the upper plate, the leaf springs are arranged between the spacer and the lower plate so as to correspond to the fastening pins respectively, the back part thereof is attached to the spacer or/and held between the spacer and the lower plate and the front part thereof is bent upwardly so that the end thereof substantially reaches the lower surface of the upper plate, and the lower plate has the front part projected forward from the position at which the leaf spring is bent and the upper surface which is hollowed out in the area corresponding to the bent part of each leaf spring to enable the bent edge of leaf spring to sink below the upper surface of the lower plate and a machine plate to be inserted smoothly.

12. A machine plate fastening means as described in claim 1, wherein the machine plate fastening pin has a head which has a slope on the front side so as to make the insertion of a machine plate easy and protrudes on the back side to form a hollow so as to prevent the fastened machine plate from coming off the fastening pins.

13. A machine plate fastening means as described in claim 12, wherein the machine plate fastening pin is a pin each lateral of which is cut so as to be a smooth vertical plane.

14. A machine plate fastening means as described in claim 12, wherein the back part end of the head has a tapered shape to enable easy movement of the machine plate once fastened in lateral directions.

15. A plate cylinder having a machine plate fastening means as described in claim 1 in a state that the fastening means is attached to the surface side of the upper clamp plate of a PS plate lock-up device installed therein.

16. An offset printing machine equipped with a plate cylinder as described in claim 15.

* * * * *